US007165476B2

(12) United States Patent
Panyard et al.

(10) Patent No.: US 7,165,476 B2
(45) Date of Patent: Jan. 23, 2007

(54) HOSE CLAMP TOOL

(75) Inventors: James Panyard, Livonia, MI (US); Christopher Trombetta, Commerce Township, MI (US); Richard Williford, St. Clair Shores, MI (US); Larry Peterson, Grosse Ile, MI (US); Shannon Mullane, Onsted, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 10/709,775

(22) Filed: May 27, 2004

(65) Prior Publication Data

US 2005/0262969 A1 Dec. 1, 2005

(51) Int. Cl.
*B25B 27/10* (2006.01)

(52) U.S. Cl. ..... 81/9.3; 81/486; 81/487

(58) Field of Classification Search ..... 81/9.3, 81/486, 487

See application file for complete search history.

(56) References Cited

U.S. PATENT DOCUMENTS

| | | | | |
|---|---|---|---|---|
| 4,159,725 | A | 7/1979 | Bachmann et al. | |
| 4,702,001 | A | 10/1987 | Malm et al. | |
| 5,615,575 | A * | 4/1997 | Goodwin | 73/862.541 |
| 5,647,407 | A | 7/1997 | Scott et al. | |
| 5,769,133 | A | 6/1998 | Dyer et al. | |
| 6,164,162 | A * | 12/2000 | Furundzic | 81/9.3 |
| 6,907,802 | B2 * | 6/2005 | Schneider | 81/9.3 |

* cited by examiner

*Primary Examiner*—Joseph J. Hail, III
*Assistant Examiner*—Shantese McDonald
(74) *Attorney, Agent, or Firm*—Raymond L. Coppiellie; Brooks Kushman P.C.

(57) ABSTRACT

A tool for installing a hose clamp. The tool includes a tab, an engagement surface that engages the clamp, and a sensor. The sensor provides a signal indicative of the shifting of the clamp from an open position to a closed position.

20 Claims, 3 Drawing Sheets

HOSE CLAMP TOOL

BACKGROUND OF INVENTION

1. Field of the Invention

The present invention relates to an apparatus for installing a hose clamp.

2. Background Art

Hoses are used to make connections between various fluid system components. For example, hoses are used to connect vehicle coolant system components, such as a radiator or heater core, to an internal combustion engine. These hoses are made of rubber, polymeric elastomers, or another flexible material. Connections are made by installing the hose over a pipe or mating member that extends from a fluid system component.

A hose clamp is used to hold the hose firmly against the mating member to provide a fluid tight seal between the hose and the mating member. A hose clamp is generally configured as a circular spring steel wire or band with radially extending tabs at each end of the wire. The hose clamp may be set in a pre-expanded position and glued to the outer surface of a hose to facilitate installation. One type of pre-expanded hose clamp is the "clipless" type that incorporates a latching member for holding the clamp in an open position without a separate retaining clip.

Hose connections are often made in locations that are difficult to access, such as near the bottom of an engine block. Such locations are difficult to see and inspect. If a clamp is not properly engaged, a watertight seal is not formed between the hose and the mating member. In the case of a coolant system, improper clamping can result in coolant leaks, engine overheating, warpage of the head of an engine block, and/or engine failure, thereby necessitating expensive repairs or engine replacement.

In the prior art, pliers were used to grasp and squeeze together the tabs of hose clamp to disengage the latching member and permit the clamp to move from an open position to a clamped or closed position. However, such tools did not include any feedback mechanism to confirm that the clamp had in fact moved to the closed position to secure the hose.

Recent efforts to develop a tool that incorporated a feedback mechanism are found in U.S. provisional patent application No. 60/417,894 and U.S. Pat. No. 6,952,982. The tools disclosed in these applications utilize a hook and one or more rods to engage and release a clamp. In particular, the tool disclosed in U.S. provisional patent application Ser. No. 60/417,894 unsuccessfully attempted to utilize a single rod design to release the clamp and provide feedback. This experimental tool included a single rod with a hook formed at one end. The hook is inserted into a clamp tab. When the user pulls on a lever, the hooked rod pulls on the clamp tab and a spring. If sufficient force is applied, the latching member is disengaged, permitting the clamp to move from an open position to a closed position. Disengagement of the latching member also releases tension on the spring, causing the hooked rod to recoil or kickback past its initial position to actuate a sensor, thereby signaling the release of the clamp. Such tools released clamps inconsistently and did not provide reliable feedback that the clamp had closed.

Before Applicants' invention there was a need for an apparatus to install hose clamps and to provide positive feedback indicating that the hose clamp had engaged the hose. Problems associated with the prior art as noted above and other problems are addressed by Applicants' invention as summarized below.

SUMMARY OF INVENTION

According to one aspect of the present invention, a hose clamp installation tool is provided that includes a housing having a distal end. A tab is disposed on the distal end for engaging a clamp. An engagement surface is disposed adjacent to the tab that engages the clamp to release the clamp from an open position and allow the clamp to shift to a closed position. A sensor detects the shifting of the clamp from the open position to the closed position. The sensor may be a load cell or a microphone.

The load cell may be disposed under a cover that is incorporated in the engagement surface. The cover may be adapted to move and transmit a force to the load cell when the cover contacts the clamp. The cover may have a hardness greater than or equal to the hardness of the surrounding engagement surface.

The microphone may be disposed in an aperture in the housing. A perforated cover may be disposed over the aperture an positioned near the microphone.

According to another aspect of the invention, a hose clamp installation tool is provided that includes a tubular housing having a distal end. A plurality of tabs extend from the distal end for engaging a clamp. An engagement surface is disposed adjacent to the plurality of tabs that engages the clamp to release the clamp from an open position and allow the clamp to shift to a closed position. A sensor provides a signal indicative of the shifting of the clamp.

According to another aspect of the invention, a hose clamp installation tool is provided that includes a housing having a distal end, an arm disposed on the distal end, and a sensor. The arm includes a tab and an engagement surface disposed adjacent to the tab. The surface is adapted to contact the clamp to release the clamp from an open position and allow the clamp to shift to a closed position. The sensor provides a signal indicative of the shifting of the clamp from the open position to the closed position.

The tab may include at least one beveled side that facilitates engagement of the tab and the clamp. A plurality of tabs may be employed that extend in different directions. The plurality of tabs may be disposed in a plane.

The hose clamp installation tool may also include a power source and a transmitter for sending a signal to a receiver located apart from the hose clamp installation tool. The power source and the transmitter may be connected to the sensor and disposed in the housing. An amplifier may be disposed in the housing for amplifying the signal from the sensor.

An output device may be used to provide information to an operator based on the signal from the sensor. The output device may provide an audible signal when the installation tool is not located within a predetermined distance from the receiver.

DETAILED DESCRIPTION

Figure 1:
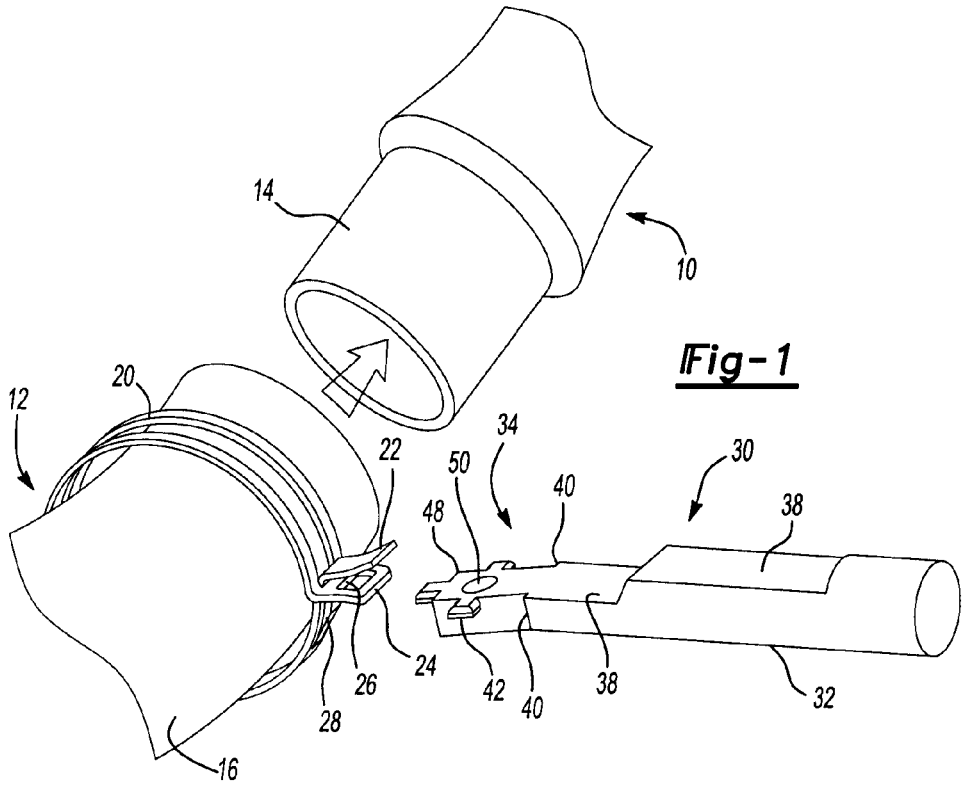
FIG. 1 is a perspective view of a hose clamp installation tool and a hose assembly before installation.

Referring to FIG. 1, a conduit 10 and a hose assembly 12 are shown. The conduit 10 may be part of a vehicle component through which a fluid, such as coolant, is circulated. For instance, the conduit 10 may be part of a heating or cooling system component such as an engine, radiator, or heater core. The conduit 10 includes a flange 14 that mates with the hose assembly 12.

The hose assembly 12 includes a hose 16 and a clamp 20. The clamp 20 may be attached to the hose 16 in any suitable manner, such as with an adhesive. In FIG. 1, the clamp 20 is shown in an open position to facilitate sliding of the hose 16 over the flange 14 in the direction indicated by the arrow. The clamp 20 includes a first tab 22 and an aperture tab 24. The aperture tab 24 includes an aperture 26. A latch 28 engages the aperture tab 24 for holding the clamp 20 in the open position.

Figure 2:
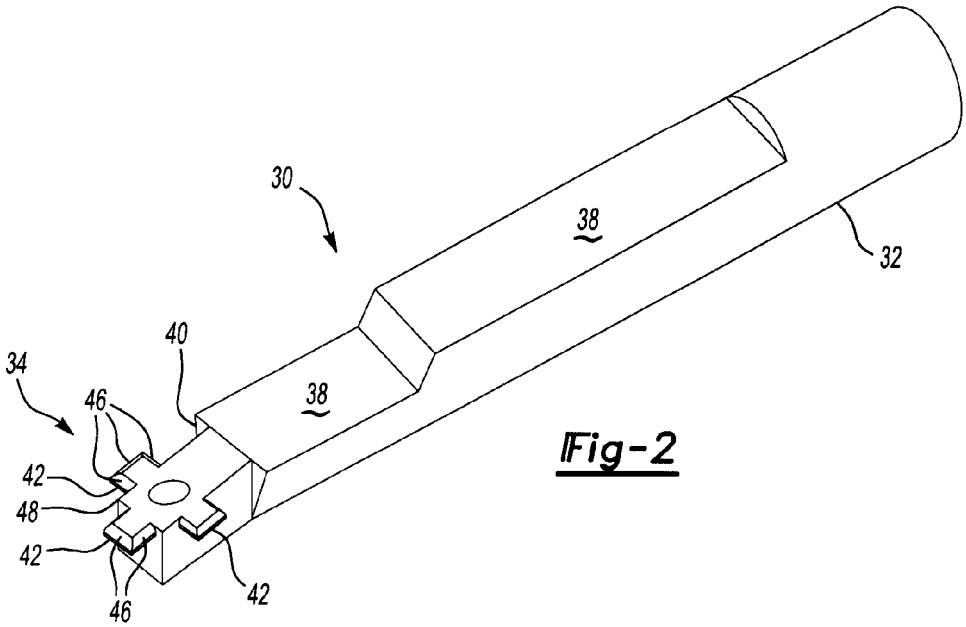
FIG. 2 is a perspective view of one embodiment of the hose clamp installation tool.
Figure 3:
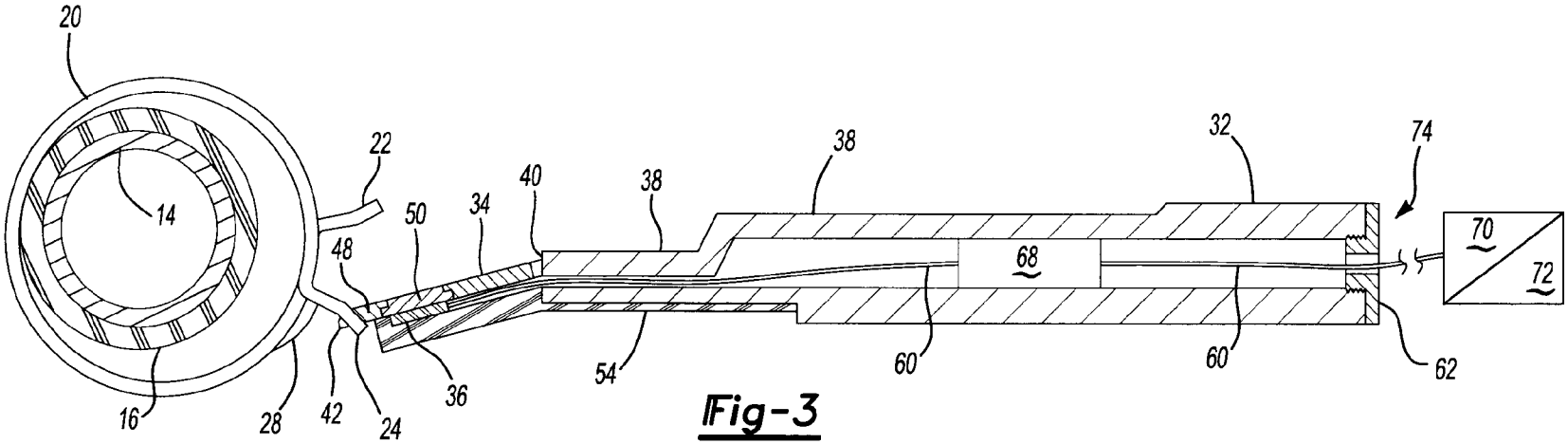
FIG. 3 is a section view of the hose clamp installation tool shown in FIG. 2 engaging a hose clamp that is latched in an open position.

Referring to FIGS. 1–3, a hose clamp installation tool 30 is shown. The tool 30 includes a handle portion or housing 32, a prying member or engagement arm 34, and a sensor 36.

The housing 32 may have any suitable configuration. In one embodiment, the housing may have a tubular configuration such that the housing 32 is hollow. The housing 32 may include at least one flat 38 that facilitates grasping of the tool 30 and improves ergonomics. In addition, the housing 32 may be made of any suitable material, such as a polymeric material like nylon or metal.

The engagement arm 34 may be disposed at a first end 40 of the housing 32. The engagement arm 34 may be made of any suitable material, such as steel, that can withstand the forces associated with releasing the clamp 20. The prying member 34 may include one or more tabs 42. The tabs 42 extend from the engagement arm 34 and may have any suitable configuration. In the embodiment shown in FIG. 2, three tabs 42 are shown that extend perpendicular to each other and are disposed in a common plane. The tabs 42 may have at least one beveled edge 46 to facilitate engagement of the tab 42 and the clamp 20. More specifically, the beveled edge 46 helps the tab 42 enter the aperture 26 of the clamp 20.

Referring to FIGS. 2 and 3, the engagement arm 34 also includes an engagement surface 48 that is configured to transmit force to the first tab 22 of the clamp 20 to release the latch 28 and allow the clamp 20 to shift from the open position to the closed position. The engagement surface 48 may include a cover 50. The cover 50 is free to move relative to the surrounding engagement surface. The cover 50 may have any suitable configuration and be made of any suitable material, such as steel. In addition, the cover 50 may be made of a material having a hardness greater than the engagement surface 48 surrounding the cover 50 to improve durability and better withstand wear.

The engagement arm 34 may be supported by a support plate 54 that provides support and rigidity during engagement of the clamp 20. The engagement arm 34 and/or support plate 54 may be attached to the housing 32 and/or each other in any suitable manner, such as with fasteners or adhesive.

The sensor 36 may be disposed between the cover 50 and the support plate 54. The sensor 36 may be of any suitable type, such as a load cell or a microphone. In the embodiment shown, the sensor 36 is a load cell that detects force transmitted through the cover 50.

The tool 30 may have a "wired" or "wireless" configuration. (Characteristics associated with the "wireless" tool will be described below in association with FIG. 6.)

Figure 4:
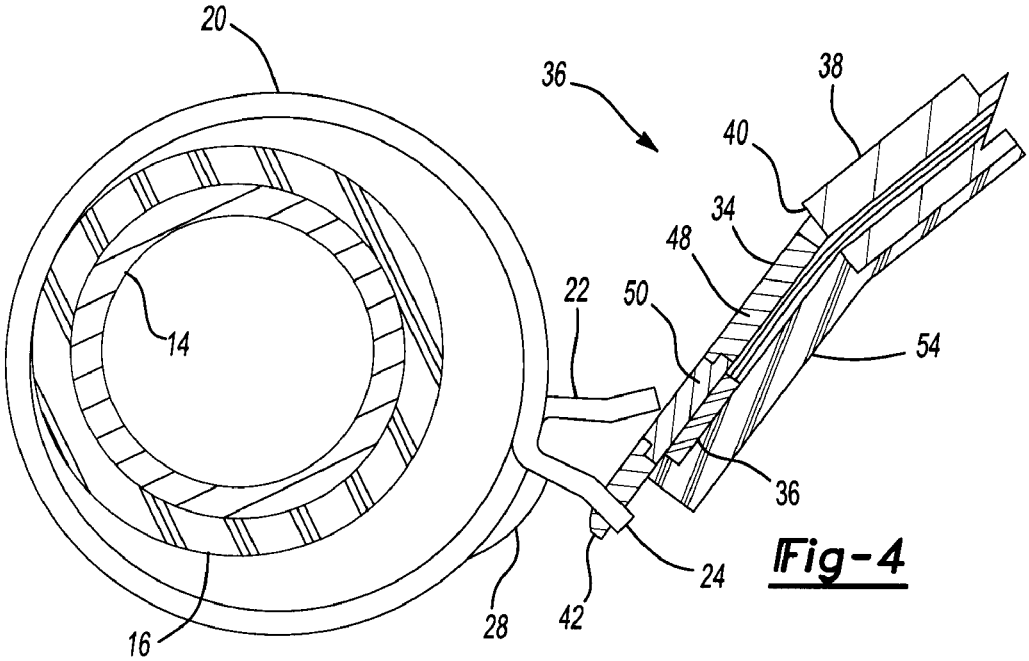
FIG. 4 is a section view of the hose clamp installation tool shown in FIG. 2 positioned to release the hose clamp from the open position to a closed position.
Figure 5:
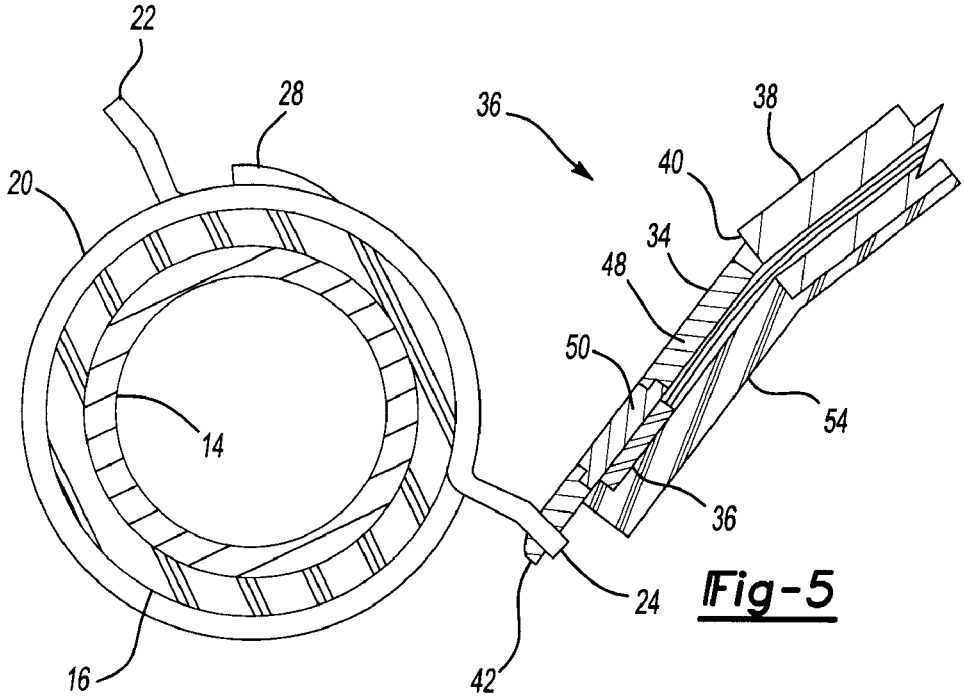
FIG. 5 is a section view of the hose clamp installation tool shown in FIG. 2 with the hose clamp shifted to the closed position.

In the "wired" embodiment shown in FIGS. 3–5, at least one wire or cable 60 is connected to the tool 30. More specifically, the sensor 36 is connected to a cable 60 that is connected to a power source 70 located apart from the tool 30. In addition, a signal indicative of the engagement of the clamp 20 may be transmitted via cable 60 from the sensor 36 to a monitoring device 72 that may include a microprocessor or electronic circuit for processing the signal.

The cable 60 may pass through a cap 74 located a second end 76 of the housing 32 opposite the sensor 36. Optionally, the cable 60 may pass through a flexible conduit (not shown) that is coupled to the second end 76 of the tool 30.

Optionally, an amplifier 68 may be used to amplify the signal from the sensor 36. The amplifier 68 may be disposed inside the housing 32 or be located apart from the tool 30. The amplifier 68 may be of any suitable type, such as an Entran IAM amplifier, model number IAM-15/15/50-1W-/LO.25F/C. If the amplifier 68 is located inside the housing 32, it may be secured in place in any suitable manner, such as with foam, clip, or by physical contact with the inside diameter of the housing 32.

Referring to FIGS. 3–5, the operation of the tool 30 will now be described. In FIG. 3, the tool 30 is shown with tab 42 in engagement with the clamp 20, which is latched in the open position. Specifically, tab 42 is inserted into the aperture 26. In FIG. 4, the tool 30 is moved such that the engagement surface 48 contacts the first tab 22 of the clamp 20. More specifically, the cover 50 is shown in contact with the first tab 22. As the tool 30 is advanced, additional force is exerted on the clamp 20. When sufficient force is applied, the latch 26 is released and the clamp 20 is permitted to shift from the open position to the closed or clamped position as shown in FIG. 5.

When the clamp 20 shifts to the closed position, the first tab 22 moves away from the engagement surface 48 and the cover 50. As a result, the force exerted on the tool 30 decreases. This force is detected by the sensor 36. The signal generated by the sensor 36 reflects the decrease in force when the clamp 20 is released. This signal can be processed and used to activate an indicator representative of a successful clamp release. The indicator may be of any suitable type such as a light, buzzer, or counter. In addition, the signal may be stored in a database. Alternatively, failure to obtain a successful installation signal could be used to halt a vehicle assembly line.

Figure 6:
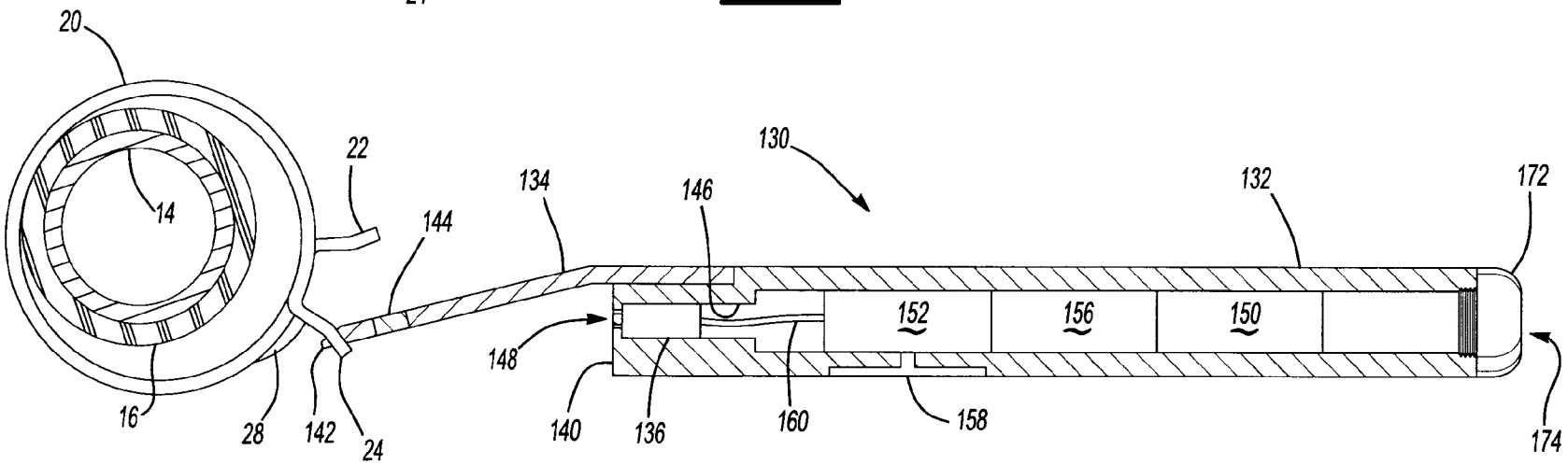
FIG. 6 is a section view of another embodiment of the hose clamp installation tool.

Referring to FIG. 6, another embodiment of a hose clamp installation tool 130 is shown. In this embodiment, the tool 130 includes a housing 132, an engagement arm 134, and a sensor 136. The housing may have any suitable configuration and be made of any suitable material as previously discussed.

The engagement arm 134 may be disposed at a first end 140 of the housing 132. The engagement arm 134 may include one or more tabs 142 and an engagement surface 144 as previously discussed.

The sensor 136 may be disposed in any suitable location, such as in an aperture 146 located in the first end 140 of the housing 132. In one embodiment, the sensor 136 is a microphone that detects the sound that occurs when the clamp 20 shifts to the closed position. The sensor 136 may be disposed near a perforated cover 148 that is disposed over the sensor 136 and aperture 146.

Like the embodiment previously described, the tool 130 may have a "wired" or "wireless" configuration. A "wireless" tool includes a power source 150. The power source 150 may be of any suitable type, such as a battery. In addition, the tool 130 may include a transmitter 152 that transmits the signal from the sensor 136 to a receiver 154 located apart from the tool 130.

Optionally, the "wireless" tool may include an amplifier 156 and/or a display 158. The amplifier 156 may be used to amplify the signal from the sensor 136 and may be disposed in the tool 130 or located remotely. For instance, the amplifier 156 may be incorporated with the receiver 154. The display 158 may be of any suitable type, such as a light emitting diode (LED) or a liquid crystal display (LCD).

A cable 160 may be used to connect the sensor 136 to the power source 150 and/or transmitter 152. The cable 160 may transmit a signal indicative of the engagement of the clamp 20 from the sensor 136 to the transmitter 150.

An end cap 172 may be located at a second end 174 of the housing 132 and opposite the sensor 136. In FIG. 6, the end cap 172 is shown threaded into the housing 132, but it may be secured in any suitable manner.

The tool 130 operates similar to the embodiment previously discussed. First, the tool 130 engages an open clamp 20 with tab 142. Next, the tool 130 is moved such that the engagement surface 144 contacts the first tab 22. As the tool 130 is advanced, additional force is exerted on the clamp 20 until the latch 26 is released and the clamp 20 is permitted to shift from the open position to the closed position. The sensor 136 detects the release of the clamp 20. In one embodiment, the tool incorporates a microphone as the sensor. The microphone detects the sound created when the clamp 20 is released and produces an appropriate signal representative of that sound. This signal can be processed and used to activate an indicator representative of a successful clamp release. The indicator may be of any suitable type such as a light, buzzer, counter, or message displayed on the display 158. In addition, the signal may be transmitted and stored in a database. Alternatively, failure to obtain a successful installation signal could be used to halt a vehicle assembly line.

While the best mode for carrying out the invention has been described in detail, those familiar with the art to which this invention relates will recognize various alternative designs and embodiments for practicing the invention as defined by the following claims.

The invention claimed is:

1. A hose clamp installation tool comprising:

a housing having a distal end;

a tab disposed on the distal end for engaging a first tab of a clamp;

an engagement surface fixedly positioned relative to the tab for engaging a second tab of the clamp to release the clamp from an open position and allow the clamp to shift to a closed position; and a sensor that detects the shifting of the clamp.

2. The hose clamp installation tool of claim 1 wherein the sensor is a load cell.

3. The hose clamp installation tool of claim 2 wherein the load cell is disposed under a cover incorporated in the engagement surface.

4. The hose clamp installation tool of claim 3 wherein the cover is adapted to move and transmit force to the load cell when the cover is in contact with the clamp.

5. The hose clamp installation tool of claim 3 wherein the cover has a hardness greater than or equal to the hardness of the engagement surface surrounding the cover.

6. The hose clamp installation tool of claim 1 wherein the sensor is a microphone.

7. The hose clamp installation tool of claim 6 wherein the microphone is disposed in an aperture in the housing.

8. The hose clamp installation tool of claim 7 further comprising a perforated cover disposed over the aperture and near the microphone.

9. A hose clamp installation tool comprising:

a housing having a distal end;

a plurality of tabs extending from the distal end for engaging a clamp;

an engagement surface disposed adjacent to the plurality of tabs for engaging the clamp to release the clamp from an open position and allow the clamp to shift to a closed position; and a sensor for providing a signal indicative of the shifting of the clamp.

10. The hose clamp installation tool of claim 9 further comprising a power source and a transmitter for sending the signal to a receiver located apart from the hose clamp installation tool.

11. The hose clamp installation tool of claim 10 wherein the power source and the transmitter are connected to the sensor and disposed in the housing.

12. The hose clamp installation tool of claim 9 further comprising an amplifier disposed in the housing for amplifying the signal from the sensor.

13. The hose clamp installation tool of claim 9 wherein the sensor is a load cell.

14. The hose clamp installation tool of claim 9 wherein the sensor is a microphone.

15. A hose clamp installation tool comprising:

a housing;

an arm extending from the housing, the arm including a tab and an engagement surface;

wherein the tab contacts a first clamp tab and the housing is moved to position the engagement surface in contact with a second clamp tab to release the clamp from an open position and allow the clamp to shift to a closed position; and a sensor for providing a signal indicative of shifting of the clamp from the open position to the closed position.

16. The hose clamp installation tool of claim 15 wherein the tab includes at least one beveled side that facilitates engagement of the tab and the clamp.

17. The hose clamp installation tool of claim 15 further comprising a plurality of tabs disposed in a plane that extend in different directions.

18. The hose clamp installation tool of claim 15 further comprising a power source for providing power to the sensor.

19. The hose clamp installation tool of claim 15 further comprising an output device for providing information to an operator based on the signal from the sensor.

20. The hose clamp installation tool of claim 19 wherein the output device provides an audible signal when the installation tool is not located within a predetermined distance from a receiver.

* * * * *